US005688756A

United States Patent [19]

Garabedian, Jr. et al.

[11] Patent Number: 5,688,756

[45] Date of Patent: *Nov. 18, 1997

[54] GELLED HYPOCHLORITE-BASED CLEANER

[75] Inventors: Aram Garabedian, Jr., Fremont; Clement K. Choy, Alamo, both of Calif.

[73] Assignee: The Clorox Company, Oakland, Calif.

[ * ] Notice: The term of this patent shall not extend beyond the expiration date of Pat. No. 5,529,711.

[21] Appl. No.: 587,314

[22] Filed: Jan. 16, 1996

Related U.S. Application Data

[63] Continuation of Ser. No. 429,433, Apr. 26, 1995, abandoned, which is a continuation of Ser. No. 97,738, Jul. 27, 1993, abandoned.

[51] Int. Cl.[6] ..... C11D 3/395

[52] U.S. Cl. ..... 510/369; 510/380; 510/418; 510/476; 252/187.24; 252/187.25; 252/186.36

[58] Field of Search ..... 252/95, 96, 187.24, 252/187.25, 186.36, 307; 510/369, 373, 380, 418, 476

[56] References Cited

U.S. PATENT DOCUMENTS

| | | | |
|---|---|---|---|
| 4,836,948 | 6/1989 | Corring | 252/99 |
| 5,130,043 | 7/1992 | Prince et al. | 252/95 |
| 5,202,046 | 4/1993 | Dixit et al. | 252/94 |
| 5,205,953 | 4/1993 | Dixit | 252/94 |
| 5,219,486 | 6/1993 | Ahmed et al. | 252/94 |
| 5,279,758 | 1/1994 | Choy | 252/104 |
| 5,529,711 | 6/1996 | Brodbeck et al. | 252/102 |

FOREIGN PATENT DOCUMENTS

| | | | |
|---|---|---|---|
| 373 864 | 6/1990 | European Pat. Off. | C11D 3/395 |
| 479 370 | 4/1992 | European Pat. Off. | C11D 17/00 |
| 606 707 | 7/1994 | European Pat. Off. | C11D 3/395 |

OTHER PUBLICATIONS

Olin Hypure Chemicals Product Data—"Hypure K Potassium Hypochlorite" (1991).

Olin Hypure Chemicals Product Data—"Hypure N Sodium Hypochlorite" (1991).

*Primary Examiner*—Ponnathapura Achutamurthy

*Attorney, Agent, or Firm*—Joel J. Hayashida; Michael J. Mazza; Harry A. Pacini

[57] ABSTRACT

The invention provides a gelled hypochlorite-based cleaner in which stability is achieved by reducing or minimizing the ionic strength of the cleaner, comprising:

(a) a cross-linked polyacrylate polymer;

(b) an amount of an bleach-stable surfactant sufficient, in combination with said polyacrylate polymer, to result in a gel;

(c) an effective amount of a source of hypochlorite, which has an ionic strength below about 5M; and (d) the balance, water.

13 Claims, No Drawings

GELLED HYPOCHLORITE-BASED CLEANER

This is a continuation of application Ser. No. 08/429,433, filed Apr. 26, 1995, now abandoned, itself a continuation of application Ser. No. 08/097,738, filed Jul. 27, 1993, now abandoned.

FIELD OF THE INVENTION

The present invention relates to gelled hypochlorite bleach-containing cleaners for use as hard surface cleaners.

BACKGROUND OF THE INVENTION

Thickened hypochlorite bleach solutions or compositions have long been used in a variety of applications including hard surface cleaning, disinfecting and the like. These compositions are typically provided with increased viscosity for a number of reasons, principally to increase residence time of the composition on non-horizontal surfaces.

Many different examples of thickened hypochlorite bleach compositions have been available from a wide variety of sources for use in hard surface cleaning. For example, Finley et al., European Patent Application EP 373,864 and Prince et al., U.S. Pat. No. 5,130,043, disclosed hypochlorite bleach compositions consisting of polyacrylate thickeners, amine oxide detergent, and optional fatty acid soap and/or a bleach stable synthetic anionic detergent for cleaning hard surfaces such as toilet bowls, bathroom tiles and shower walls. However, both of these references do not disclose, teach or suggest the need to reduce or limit the free electrolyte, or ionic strength, of thickened cleaners.

Other prior art references have also described various thickened automatic dish washing liquid compositions using polyacrylates in combination with colloidal thickeners to provide proper rheology and stability in hypochlorite bleach compositions including various adjuncts. Stoddart, U.S. Pat. No. 4,576,728, and Corring, U.S. Pat. No. 4,836,948, are representative of these other prior art references. These types of cleaners contain large amounts of builders, or other materials, which would boost the ionic strength of the resulting composition. Also, as automatic dish washing compositions (or, "ADWD's"), such cleaners typically must include silicates as overglaze protectors and contain relatively low amounts of surfactants, if at all, to prevent high foaming action.

A related application, Choy et al., U.S. patent application Ser. No. 08/003,037, filed Jan. 11, 1993, entitled "Thickened Hypochlorite Compositions with Reduced Bleach Odor and Methods of Manufacture and Use," commonly owned and assigned to The Clorox Company, discloses hypochlorite compositions generally having a maximum thickness of less than a gel and which is intended for spray dispensers, in which polyacrylate is used primarily as an odor controlling agent to prevent or minimize the volatilization of hypochlorite solution as it is dispensed from the spray dispenser.

Generally, these compositions have performed satisfactorily for their intended purpose. However, there is a need for thickened gel hypochlorite bleach composition offering improved characteristics and benefits.

SUMMARY OF THE INVENTION

The invention provides a gelled hypochlorite-based cleaner in which stability is achieved by reducing or minimizing the ionic strength of the cleaner, comprising:

(a) a cross-linked polyacrylate polymer;

(b) an amount of an bleach-stable surfactant sufficient, in combination with said polyacrylate polymer, to result in a gel;

(c) an effective amount of a source of hypochlorite, which has an ionic strength below about 5M; and (d) the balance, water.

It is an object of the invention to provide a gelled hypochlorite bleach-containing composition having combined benefits of thickening and stability.

For the purposes of the invention, a gel is a colloid comprising a continuous phase, which is mostly water, in which a dispersed phase, which is the actives, is dispersed in a manner such as to provide a viscous, jelly-like product. The gel is translucent to transparent and may also be opalescent. The gel is a favorable physical state for a hard surface cleaner since it may be dosed or extruded onto a vertical or inclined surface for localized cleaning, e.g., stained bathroom tiles or grout, or the like. Since the gel will be less fluid, or mobile, than a more liquid phase composition, there is little concern with overdosing and spillage. The gel is also an attractive medium for cleaning since it can be colored, or tinted, with, typically, a hypochlorite-bleach stable dye, colorant or pigment.

As disclosed herein, cross-linked polyacrylate polymers available for example under the trademark CARBOPOL from B.F. Goodrich Company and under the trademark POLYGEL from 3V Chemical Company, combined with bleach-stable surfactants, have surprisingly and unexpectedly been found to produce desired benefits of thickening or viscosity increase and stabilization in such hypochlorite-containing compositions. The cross-linked polyacrylate polymers generally form from about 0.2 to about 5.0 weight percent of the composition and more preferably from about 0.6 to about 3.0 percent weight of the composition for achieving the combined characteristics of thickening and stabilization. The bleach-stable surfactants, on the other hand, are about 0.2 to about 5.0% of the composition, most preferably about 0.3 to about 3.5%.

Combinations or mixtures of different cross-linked polyacrylate polymers are also preferably used in the present invention as being desirable for providing their combined properties or characteristics in such compositions.

The amount of the cross-linked polyacrylate polymer and other components of the composition are selected in order to achieve gelation in the broad range of from about 1,000 centipoise ("cps") up to about 100,000. Preferably, the composition of the invention has a maximum thickness of up to about 50,000 cps, more preferably a maximum thickness of about 40,000 cps and most preferably a viscosity range of about 3,500–30,000 cps in order to achieve optimum viscosity, along with yield values in the preferred range of about 75–5,000 dynes/cm$^2$.

The invention includes the bleach stable surfactant bleach-stable which, in combination with the cross-linked polyacrylate polymers, results in the gel compositions of this invention. Further surfactants and/or co-thickeners may be selected from a wide variety of well known surfactants such as alkyl carboxylates, or soaps.

It is necessary to minimize or avoid the presence of salts such as sodium chloride within the compositions, so the hypochlorite is preferably selected or formed in a manner avoiding the presence of undesirable salts. For example, hypochlorite bleaches are commonly formed by bubbling chlorine gas through liquid sodium hydroxide or corresponding metal hydroxide to result in formation of the corresponding hypochlorite. However, such reactions are undesirable for the present invention since they commonly result in formation of a salt such as sodium chloride.

The present invention thus preferably uses hypochlorites formed for example by reaction of hypochlorous acid with sodium hydroxide or other metal hydroxides in order to produce the corresponding hypochlorite with water as the only substantial by-product. Sodium hypochlorite bleach produced in this manner is referred to as "high purity, high strength" bleach and is available from a number of sources, for example Olin Corporation which produces sodium hypochlorite bleach as a 30% solution in water. See, for example, Olin "Hypure K Potassium Hypochlorite" Product Data (1991), and Olin "Hypure N Sodium Hypochlorite" Product Data (1991), both of which are incorporated herein by reference. The resulting solution is then diluted to produce the hypochlorite composition of the present invention.

The hypochlorite may be formed with other alkaline metals as are well known to those skilled in the art. Although the term "hypochlorite" is employed herein, it is not intended to limit the invention only to the use of chloride compounds but is also intended to include other halides or halites, as discussed in greater detail below. Generally, the present invention preferably uses potassium hypochlorite and sodium hypochlorite produced by the high strength bleach process. To be avoided or minimized is a hypochlorite of any alkali metal including a chloride salt of the corresponding alkali metal. Here again, hypohalites formed with similar alkaline metals are similarly to be minimized. Furthermore, it is especially desirable that the hypochlorite of the invention either avoids the inclusion of a chloride salt as noted above or includes such a chloride salt only within a range of up to about 5% by weight of the composition. As the hypochlorite component is increased from about 1% by weight of the composition, the chloride salt should be even further reduced since the chloride salt, particularly in the presence of the hypochlorite component, makes it difficult to achieve desirable thickening of the composition, or stability.

The hypochlorite and any salt present within the composition are also the principal source of ionic strength for the composition. The ionic strength of the composition has an effect on thickening, that is, if the percentage of salt as noted above is exceeded, it becomes difficult to achieve desirable thickening in the composition. Moreover, high ionic strength is detrimental to the stability of the composition. In summary, the ionic strength of the compositions of the present invention is maintained preferably less than about 5M, more preferably less than about 3M, and most preferably less than about 1.5M, and may be adjusted by varying the amount of hypochlorite and minimizing salt in the composition.

A stabilizer may also preferably be included in the composition to assure stability for the combination of the hypochlorite bleach and the cross-linked polyacrylate polymers. The stabilizer is present in a minimum amount for the dual purposes of (1) neutralizing the polymer to enhance its thickening effect, and (2) to buffer the hypochlorite. For both of these purposes, the stabilizer is present in the composition in an amount for maintaining the pH of the composition at a minimum level of about 12 and preferably in a range of about 12–13. The stabilizer is preferably present in the composition on a mole equivalent basis with reference to the cross-linked polyacrylate polymer for neutralizing the polymer as summarized above.

Both the hypochlorite bleach and the stabilizer are preferably selected in order to achieve optimum, or rather, minimal ionic strength for the composition. In accordance with the preceding discussion, potassium hydroxide is a preferred stabilizer with sodium hydroxide being a secondary interest in the invention. Here again, it is believed that the selection of potassium as the alkali metal in both the hypochlorite component and the stabilizer serves to increase both solubility of the gelled composition and to stabilize the cross-linked polymer. In other words, potassium is a preferred alkali metal in both the hypochlorite bleach component and the stabilizer, which serves to enhance the desirable characteristic of stability while also providing optimum ionic strength in the composition. It is also believed that there is less tendency for the cross-linked polyacrylate polymer to be precipitated from the composition, or in other words, to exhibit phase sensitivity in the presence of potassium as an alkali metal. Accordingly, the thickening effect of the cross-linked polyacrylate polymers is also enhanced by the selection of both the hypochlorite component and the stabilizer.

The compositions of the present invention may also include other components either for enhancing one or more of the effects discussed above or for other purposes. For example, there is preferably included a bleach stable fragrance. Additional adjuncts in the hypochlorite composition may include a source of alkalinity for adjusting pH of the composition, colorants, fluorescent whitening agents (FWA), etc. However, it is again noted that such adjuncts are selected to the extent that they not substantially interfere with the preferred characteristics of the present invention. For example, builders, buffers, electrolytes, and certain inorganic thickeners which would increase the ionic strength of the gel compositions of the invention should be avoided.

Additional objects and advantages of the present invention are made apparent in the following detailed description of the invention and specific examples further embodying the invention.

DETAILED DESCRIPTION OF THE PREFERRED EMBODIMENTS

The different embodiments of the present invention set forth below commonly relate to liquid hypochlorite bleach compositions including a number of components and are adapted for a variety of specific applications as discussed above. The respective components of the composition of the invention are discussed below together with a discussion of desired characteristics resulting from those components. Thereafter, a number of examples or preferred embodiments of the invention are set forth in an Experimental Section.

As summarized above, the present invention essentially relates to a gelled hypochlorite bleach-containing composition comprising an aqueous solution of a hypochlorite together with a cross-linked polyacrylate polymer and an bleach-stable surfactant, with an optional stabilizer for stabilizing the polymer and the hypochlorite in the invention.

The basic composition of the invention further includes a bleach stable surfactant or surfactants either for enhancing the thickening effects of the cross-linked polyacrylate polymer and for achieving other desirable purposes within the composition.

The gelled composition of the present invention also preferably comprises a solvent co-thickener which is also bleach stable and is included within the composition. Additional components may be included in the composition and are discussed in greater detail below together with the preferred component summarized above.

Hypochlorite

Within the composition of the present invention, hypochlorite is selected for use in combination with the cross-linked polyacrylate polymer and the bleach-stable surfactant. Generally, the hypochlorite may be provided by a variety of sources. Hypochlorite compounds or compounds producing hypochlorite or hypohalite in aqueous solution are preferred. Representative hypohalite-producing compounds include sodium, potassium, lithium and calcium hypochlorite, chlorinated trisodium phosphate dodecahydrate, potassium and sodium dichloroisocyanurate and trichlorocyanuric acid. Other N-chloroimides, N-chloroamides, N-chloramines, and chlorohydantoins are also suitable. Other hypohalite and hypohalite producing compounds are well known for use in such bleaching compositions and are also contemplated by the present invention. Accordingly, the compounds summarized above are intended to be representative and not limiting as to the scope of the invention.

The hypochlorite is present in the composition in an amount equal to about 0.1 to about 10%, more preferably 0.1 to about 5%, by weight of the composition. Most preferably, the hypochlorite may form about 0.5–3.0% by weight of the composition for increased stability.

The hypochlorite should be present in the composition in a form in which salts are minimized or absent, such as chlorides, which interfere with stability, the viscosity, or both, of the composition. For this reason, the present invention preferably avoids the use of hypochlorite bleaches formed by methods commonly generating salts such as sodium chloride as discussed above.

Most preferably, the hypochlorite comprises potassium hypochlorite, sodium hypochlorite produced by the high strength bleach process and generally any hypochlorite of an alkali metal absent salts such as chlorides which have been found to interfere with stability.

Preferably, the hypochlorite and accompanying constituents such as salts are selected with the composition of the present invention in order to enhance phase stability of the composition achieved by the cross-linked polyacrylate polymers in conjunction with the bleach-stable surfactants, resulting in the characteristic thickening.

Cross-Linked Polyacrylate Polymer

The cross-linked polyacrylate polymers of the present invention are generally characterized as resins in the form of acrylic acid polymers. These resins are well known for use in a number of applications.

Such cross-linked polyacrylate polymers are available from a number of sources including materials available under the trademark CARBOPOL from B.F. Goodrich Company and under the trademark POLYGEL available from 3V Chemical Company. Cross-linked polyacrylate polymers suitable for use in the present invention are also available from other commercial sources.

The cross-linked polyacrylate polymers are generally characterized as acrylic acid polymers which are non-linear and water-dispersible while being cross-linked with an additional monomer or monomers in order to exhibit a molecular weight in the range from several hundred thousand to about 4,000,000. Preferably, the polymers are cross-linked with a polyalkenyl polyether, the cross-linking agents tending to interconnect linear strands of the polymers to form the resulting cross-linked product.

Generally all cross-linked polyacrylate polymers are effective for achieving generally good stability in compositions of the present invention. However, some differences particularly in terms of stability have been observed for different cross-linked polyacrylate polymers. Suitable cross-linked polyacrylate polymers for purposes of the present invention include the 600 series, 900 series, 1300 series and 1600 series resins available under the trademark CARBOPOL from B.F. Goodrich. More specific examples of polymers selected from these series include Carbopol 617 and 623. Similarly, effective cross-linked polyacrylate polymers for purposes of the present invention also include those available under the trademark POLYGEL and specified as DA, DB, and DK, from 3V Chemical Company. The present invention can also use mixtures or combinations of such polymers in order to produce the inventive compositions.

Generally, the cross-linked polyacrylate polymers of the present invention are believed to be tightly coiled in a presolvated condition with relatively limited thickening capabilities. Upon being dispersed in water, the polymer molecules are hydrated and uncoil or relax to varying degrees. Thickening is particularly effective with the polyacrylate polymers when they are uncoiled or relaxed as noted above. Uncoiling of the polyacrylate polymers may be achieved for example by neutralizing or stabilizing the polymer with inorganic bases such as sodium hydroxide, potassium hydroxide, ammonium hydroxide or low molecular weight amines and alkanolamines, although these latter compounds are unstable in bleach). Neutralization or stabilization of the polyacrylate polymers in this manner rapidly results in almost instantaneous thickening of an aqueous solution containing the polymers.

The particular effectiveness of the cross-linked polyacrylate polymers in the present invention is believed to be due to a characteristic yield point or yield value. In this regard, it is noted that a typical liquid tends to deform as long as it is subjected to a tensile or shear stress. For such a liquid under shear, the rate of deformation or shear rate is generally proportional to the shear stress. This relationship was originally set forth in Newton's Law and a liquid exhibiting such propositional or straight-line characteristics are commonly termed Newtonian liquids.

However, other liquids tend to exhibit shear thinning with a shear stress increasing more rapidly than for a Newtonian liquid. Such liquids are commonly referred to as being "plastic". Still other liquids exhibit plastic or shear thinning characteristics as noted above while also initially behaving as solids until the shear stress exceeds a certain value, the so-called "yield stress" or "yield value," after which point the shear stress increases more rapidly than Newtonian liquids. Such liquids are commonly referred as being pseudoplastic, or thixotropic, and include the gels of the present invention. The composition's yield values are in the range of about 75–5,000 dynes/cm$^2$, most preferably about 100–1,000 dynes/cm$^2$. The yield values of the inventive gel are important characteristics of the gel and such yield values allow it, unlike even thickened liquids, to adhere to a vertical surface and remain immobile upon being dispensed thereon. Thus, again, unlike thickened liquids, the gel can be targetted for problematic stains on vertical surfaces without concern that the gel would migrate after being contacted to the stain.

It has been further found that high shear conditions should be avoided during formation of the compositions of the present invention in order to maintain desirable stability. Thus, it has been found desirable to employ relatively gentle dispersion techniques or mixing with reduced shear in order to maintain good stability within the resulting compositions.

In this regard, it is difficult to define acceptable shear in blending or mixing the compositions. Generally, it is theorized that excessive shear tends to rupture the cross-linked polyacrylate polymers so that their ability to achieve thickening is at least minimized. In any event, this discussion of preferably employing relatively low shear for forming the compositions of the present invention is set forth only for the purpose of assuring a complete understanding of the invention while not intending to specifically limit the scope of the invention.

The compositions of the present invention preferably entrain air, leading to the retention of rather immobile air bubbles. This particular attribute is aesthetically pleasing to the consumer and allows the product to be distinguished as a gel, rather than as a thick liquid.

As previously stated, the gelled compositions of the present invention should have a thickness in the broad range of from about 1,000 centipoise. In the present invention, such gels are assumed to have a thickness in the range of about 1,000–100,000 centipoise (cps), more preferably, between about 2,000–50,000 cps, and most preferably, between about 3,500–40,000 cps. Excellent product performance is expected to occur at between about 5,000–20,000 cps.

In the invention, stability includes both chemical stability within the composition and phase stability. Phase stability is also affected by a stabilizer which is discussed below. Generally, the characteristic of phase stability is dependent upon selection of the hypochlorite bleach and the avoidance of salts such as chloride salts which have been found to interfere with stability.

Phase stability for the compositions of the present invention is of course dependent upon storage conditions. Generally, it has been found that the compositions of the present invention including the cross-linked polyacrylate polymers exhibit at least good stability over long term storage conditions including, for example, storage at 70° F. (21° C.) for periods of four months and 300 days. In addition to enhancing stability through the use of a stabilizer as discussed below, the ionic strength of the bleach composition is preferably controlled by proper selection of the hypochlorite bleach and the stabilizing agent for achieving maximum stability.

Surfactant

As summarized above, surfactants are added to the hypochlorite composition for both thickening (in addition to the cross-linked polyacrylate polymer) and for non-thickening purposes such as cleaning, improved phase stability, etc. Bleach stability in the presence of the hypochlorite component is a basic criteria for selecting a surfactant or surfactants to be included in the composition. Generally, a wide variety of surfactants may be stable in the presence of bleaches such as hypochlorite in an aqueous solution including but not limited to amine oxides, betaines, sarcosinates, taurates, alkyl sulfates, alkyl sulfonates, alkyl aryl sulfonates, alkyl phenol ether sulfates, alkyl diphenyl oxide sulfanates, alkyl phosphate esters, etc. In the invention, the preferred surfactant is a semi-polar nonionic surfactant, amine oxide. These have the general configuration:

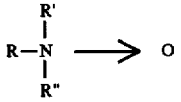

wherein R is $C_{6-24}$ alkyl, and R' and R" are both $C_{1-4}$ alkyl, although R' and R" do not have to be equal. These amine oxides can also be ethoxylated or propoxylated. The preferred amine oxide is lauryl amine oxide, such as Barlox 12, from Lonza Chemical Company.

Generally, co-surfactants may be any of a variety of different types including anionics, nonionics, amphoterics, etc. These various classes of bleach stable surfactants are described in greater detail below.

Bleach-stable anionic surfactants useful in the present invention and which are especially stable in the presence of hypochlorite include two principal groups. One group comprises bleach-stable anionics surfactants, more specifically water-soluble alkyl sulfates and/or sulfonates, particularly those including from about 8 to 18 carbon atoms in the alkyl group. Especially preferred are $C_{6-24}$ alkyl carboxylates, commonly known as soaps, and which may be either completely saturated, or partially unsaturated. Examples of preferred soaps include $C_{12}$, $C_{14}$, and $C_{16}$ saturated soaps, and coco soaps, among partially unsaturated soaps. Examples of vendors for these soaps include Henkel Corp. and Witco Chemical. Soaps have been found to perform well in the invention because they help to co-thicken the compositions and they are expected to impart increased rinsability to the gel cleaners from surfaces to which the gel cleaners have been applied.

A group of bleach-stable amphoteric surfactant materials suitable for the compositions of the present invention include water-soluble betaine surfactants having the general formula:

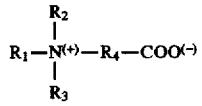

wherein $R_1$ is an alkyl group containing from about 8 to 18 carbon atoms; $R_2$ and $R_3$ are each lower alkyl groups containing from about 1 to 4 carbon atoms and $R_4$ is an alkalene group selected from the group consisting of methylene, propylene, butylene and pentylene.

Other bleach-stable surfactants include phosphine oxides and sulfoxides.

Additional bleach-stable surfactants suitable for use in the present invention include alkyl phosphonates and anionic surfactants including linear or branched alkali metal mono- and/or di-($C_{8-14}$) alkyl diphenyl oxide mono- and/or disulphonates, commercially available from Dow Chemical Co. under the trademarks DOWFAX 3B-2 (sodium n-decyl diphenyloxide disulphonate) and DOWFAX 2A-1.

The amount of surfactant varies, but it is preferred to be present in the range of about 0.2 to about 5.0% of the composition, most preferably about 0.3 to about 3.5%.

Other Adjuncts

Compositions formulated in accordance with the present invention may also include other components such as coloring agents, fluorescent whitening agents (FWA), chelating agents and corrosion inhibitors (to enhance performance, stability and/or aesthetic appeal of the composition). Generally, all such adjuncts are also selected with the essential or at least preferable characteristic of being bleach or hypochlorite resistant. Examples of such adjuncts are to be found in the specifications of Chang et al., U.S. Pat. No. 4,708,816 and Colborn et al., U.S. Pat. Nos. 5,080,826 and 4,863,633, the disclosures of which are incorporated herein by reference thereto.

The novel and unexpected benefits of the cross-linked polyacrylate polymers in achieving the essential characteristics of thickening and stabilization have been found to differ substantially from other thickeners employed in such compositions. It is of course well known to employ a variety of materials for general purposes of thickening. For example, typical thickeners include inorganic thickeners which are usually colloidal and may include clay, alumina or alumina with surfactants, organic thickeners which are usually surfactants and may be combined with solvents or electrolytes or may be in the form of broad-shaped micelles, or other polymer thickeners such as xanthan gum, cellulose or even normal types of polyacrylates as discussed above. It has been found according to the present invention that such thickeners are unsatisfactory. More specifically, inorganic thickeners are generally undesirable particularly in gel-type cleaners since the thickeners would interfere with the product's stability. Both the inorganic and organic thickeners are unsatisfactory because they are unstable, unlike the cross-linked polyacrylate polymers preferred by the invention.

Referring particularly to polymer thickeners, there is also a problem of stability with natural thickeners such as xanthan gum and cellulose since the hypochlorite would tend to attack the thickener. Additionally, builders and electrolytes are undesirable in the invention since they will either destabilize, thin, or both, the gel cleanser. For example, a common builder used in ADWD's, $K_2CO_3$, has the undesirable effect of reducing viscosity of the gel cleanser.

Solvent Co-Thickener

It has been additionally discovered that the use of certain preferred solvents, which are terpene derivatives, surprisingly result in added thickening in the inventive gel cleaners. These particular solvents are commonly used as constituents for proprietary fragrance blends and it was not expected that such solvents would have a substantive effect on the gel cleaners in addition to their roles as part of an aesthetic adjunct, namely, the fragrance. The terpene derivatives useful herein include terpene hydrocarbons with a functional group. Effective terpenes with a functional group include, but are not limited to, alcohols, ethers, esters, aldehydes and ketones. Additionally, these solvent co-thickeners are preferably hypochlorite bleach-stable.

Representative examples for each of the above classes include but are not limited to the following: Terpene alcohols, including, for example, verbenol, transpinocarveol, cis-2-pinanol, nopol, iso-borneol, carbeol, piperitol, thymol, α-terpineol, terpinen-4-ol, menthol, 1,8-terpin, dihydro-terpineol, nerol, geraniol, linalool, citronellol, hydroxycitronellol, 3,7-dimethyl octanol, dihydro-myrcenol, β-terpineol, tetrahydro-alloocimenol and perillalcohol; Terpene ethers and esters, including, for example, 1,8-cineole, 1,4-cineole, isobornyl methylether, rose pyran, α-terpinyl methyl ether, menthofuran, trans-anethole, methyl chavicol, allocimene diepoxide, limonene mono-epoxide, iso-bornyl acetate, nopyl acetate, α-terpinyl acetate, linalyl acetate, geranyl acetate, citronellyl acetate, dihydro-terpinyl acetate and neryl acetate; Terpene aldehydes and ketones, including, for example, myrtenal, campholenic aldehyde, perillaldehyde, citronellal, citral, hydroxy citronellal, camphor, verbenone, carvenone, dihyro-carvone, carvone, piperitone, menthone, geranyl acetone, pseudo-ionone, α-ionone, β-ionone, iso-pseudo-methyl ionone, normal-pseudo-methyl ionone, iso-methyl ionone and normal-methyl ionone.

Terpene hydrocarbons with functional groups suitable for use in the present invention are discussed in substantially greater detail by Simonsen and Ross, *The Terpenes*, Volumes I–V, Cambridge University Press, 2nd Ed., 1947 (incorporated herein by reference thereto). See also, co-pending and commonly assigned U.S. patent application Ser. No. 07/780,360, filed Oct. 22, 1991, now U.S. Pat. No. 5,279,758 of Choy, incorporated herein by reference thereto.

The terpene derivatives have been found to significantly enhance the thickening of the gel cleaners. This observation was first made when applicants attempted to incorporate preferably bleach-stable fragrances into the gel cleaners. Certain preferred fragrances from the commercial vendors International Flavors and Fragrances, J.E. Sozio Inc., Firmenich, Dragoco, Givaudan and Quest were determined to contribute to co-thickening in the order of approximately 10–25% further than the base formulations. Each of these fragrances was determined to have common amongst them at least one terpene derivative. It has been found that tetrahydromyrcenol is especially preferred as thickening co-solvent. The amount of the thickening co-solvent can be quite small yet still have a thickening effect. For the purposes of the invention, the preferred amount is from about 0.005 to 5%, and most preferably about 0.01 to 2%.

Stabilizer

As noted above, a stabilizer is preferably employed for achieving optimum stability of the hypochlorite and the cross-linked polyacrylate polymer within the gel cleaner. As noted above, the stabilizer is preferably either potassium hydroxide or sodium hydroxide, added in stabilizing effective amounts of around 0.01–2%.

Miscellaneous Adjuncts

Further additives or adjuncts can be present in this invention. These can include a source of alkalinity for adjusting pH of the composition (and thus, can overlap with the hydroxide stabilizer discussed above), pigments, dyes, colorants, fluorescent whitening agents (FWA), etc. However, it is again emphasized that such adjuncts are selected to the extent that they not substantially interfere with the preferred characteristics of the present invention. For example, builders, buffers, electrolytes, and certain inorganic thickeners which would increase the ionic strength, or lessen the viscosity, of the gel compositions of the invention, should be avoided. Further, when a coloring agent, such as a bleach-stable or -resistant dye is used, it is preferred to include a periodate stabilizer for such dye, such as described in Gamlen, U.S. Pat. No. 4,065,545, although actually discussed much earlier in Lister, "The Stability of Some Complexes of Trivalent Copper," *Can. Jour. of Chemistry*, Vol. 31, pp. 638–52 (1953).

In the Experimental Section which follows below, the ingredients of the formulations are generally described as measured in percentages by weight (wt. %), whereas the preceding discussion described the effective amounts of such ingredients as weight percentage of active (i.e., without accounting for the water, or other solvent or diluent).

EXPERIMENTAL SECTION

In TABLE I below are presented representative examples of the inventive gel compositions.

TABLE I

| Component | wt. % | wt. % actives |
|---|---|---|
| | Example I | |
| Water | 28.940 | 95.122 |
| Carbopol 623 (2%) | 50.000 | 1.000 |
| KOH (45%) | 3.500 | 1.575 |
| NaOCL (13%) | 7.690 | 1.000 |
| Barlox 12 (30%) | 1.670 | 0.501 |
| $C_{11}COO^-K^+$(8.75%) | 8.000 | 0.700 |
| Fragrance | 0.100 | 0.100 |
| Pigment (2%) | 0.100 | 0.002 |
| | 100.000 | 100.000 |
| | Example II | |
| Water | 17.400 | 94.922 |
| Carbopol 623 (2%) | 50.000 | 1.000 |
| KOH (45%) | 3.500 | 1.575 |
| KOCL (13%) | 9.230 | 1.200 |
| Barlox 12 (30%) | 1.670 | 0.501 |
| $C_{11}COO^-K^+$(8.75%) | 8.000 | 0.700 |
| Fragrance | 0.100 | 0.100 |
| Pigment (2%) | 0.100 | 0.002 |
| | 100.000 | 100.000 |

In the following, Comparison Examples III and V and Inventive Examples IV and VI were prepared and, thereafter, their respective viscosities were compared by measuring with a Brookfield RVT viscometer, Model DVII, using a No. 2 spindle at 5 rpm. In certain of the following examples, the yield values were also determined, by using a Brookfield RVT viscometer, Model DVII, using a No. 2 spindle at 0.5 and 1.0 rpm. Readings were made after 30 seconds, or when the compositions were stable. To determine the Brookfield yield value, the following formula was used:

$(V_a-V_b)/100$=Brookfield Yield Value, where: $V_a$=viscosity@slowest available viscometer speed $V_b$=viscosity@next-to-slowest viscometer speed The comparison examples each contain 5% $K_2CO_3$, a common builder used especially in automatic dishwasher detergent compositions ("ADWD's"), and were patterned after the formulations disclosed in Finley et al., European Patent Application EP 373,864, which include such builders. It can be seen from the viscosity data that when, as in following the teachings of Finley et al., one uses a regular, relatively high salt content source of hypochlorite and a builder, which increases the ionic strength of the resulting composition, the viscosity and yield values of the compositions are significantly reduced, while the inventive gels, by contrast, have surprisingly high viscosities and yield values.

| Component | Examples III (Comp.) wt. % actives | IV (Inv.) wt. % actives |
|---|---|---|
| Carbopol 623 (2% aq. dispersion) | 40.00 | 40.00 |
| Water (distilled) | 42.08 | 47.08 |
| KOH (45%) | 3.11 | 3.11 |
| Low Salt/High Strg Bleach (14%) | 7.14 | 7.14 |
| Amine oxide (Barlox 12) | 0.50 | 0.50 |
| $K_2CO_3$ | 5.00 | — |
| | 100.00 | 100.00 |

-continued

| Component | Examples V (Comp.) wt. % actives | VI (Inv.) wt. % actives |
|---|---|---|
| Carbopol 617 (2% aq. dispersion) | 40.00 | 40.00 |
| Water (distilled) | 35.05 | 51.46 |
| KOH (45%) | 0.58 | 0.90 |
| Low Salt/High Strg Bleach (14%) | — | 7.14 |
| Reg. Bleach (5.3%) | 18.87 | — |
| Amine Oxide (Barlox 12) | 0.50 | 0.50 |
| $K_2CO_3$ | 5.00 | — |
| | 100.00 | 100.00 |

Examples III–VI had the following viscosities and, where such test was conducted, yield values:

TABLE II

| Example | Viscosity | Yield Value |
|---|---|---|
| III | 3,020 cps | not run |
| IV | 9,940 cps | not run |
| V | 1,520 cps | 42.0 dynes/cm$^2$ |
| VI | 14,600 cps | 445.0 dynes/cm$^2$ |

Further examples were conducted with additional inventive and comparison formulations. In these formulations, a higher hypochlorite concentration was used. The comparison examples again utilized $K_2CO_3$ builder.

| Component | Examples VII (Comp.) wt. % actives | VIII (Invention) wt. % actives |
|---|---|---|
| Carbopol 617 (2% aq. dispersion) | 40.00 | 40.00 |
| Water (distilled) | 15.58 | 43.37 |
| KOH (45%) | — | 1.84 |
| NaOH (50%) | 1.18 | — |
| Low Salt/High Strg Bleach (14%) | — | 14.29 |
| Reg. Bleach (5.3%) | 37.74 | — |
| Barlox 12 | 0.50 | 0.50 |
| $K_2CO_3$ | 5.00 | — |
| | 100.00 | 100.00 |

| Component | Examples IX (Comp.) wt. % actives | X (Invention) wt. % actives |
|---|---|---|
| Carbopol 617 (2% aq. dispersion) | 40.00 | 40.00 |
| Water (distilled) | 15.58 | 43.37 |
| KOH (45%) | — | 1.84 |
| NaOH (50%) | 1.18 | — |
| Low Salt/High Strg Bleach (14%) | — | 10.71 |

-continued

| | | |
|---|---|---|
| Reg. Bleach (5.3%) | 28.30 | — |
| Barlox 12 | 0.50 | 0.50 |
| $K_2CO_3$ | 5.00 | — |
| | 100.00 | 100.00 |

Examples VII–X had the following viscosities and yield values:

TABLE III

| Example | Viscosity | Yield Value |
|---|---|---|
| VII | 336 cps | 10.0 dynes/cm$^2$ |
| VIII | 2,400 cps | 85.0 dynes/cm$^2$ |
| IX | 536 cps | 17.2 dynes/cm$^2$ |
| X | 4,600 cps | 172.0 dynes/cm$^2$ |

In further examples below, the surprising co-thickening effect of certain bleach-stable solvents, which are principally terpene derivatives, was observed. These terpene derivatives are major components in fragrances and their effect was first noted when such fragrances were added to the inventive gel compositions.

In these experiments, base formulations A and B were prepared, to which were added respectively, two fragrances and the bleach stable solvent, tetrahydromyrcenol, which is a major component of such fragrances.

| | Base Formulations | |
|---|---|---|
| Ingredients | A Wt. % | B Wt. % |
| Carbopol 6.23 (2.1% active) | 40.00 | — |
| Carbopol 6.23 (1.85% active) | — | 40.00 |
| KOH (45%) | 2.70 | 2.70 |
| Low Salt/High Strg Bleach (14%) | 10.71 | 10.71 |
| Barlox 12 | 1.67 | 1.67 |
| Coco fatty acid | 0.70 | 0.70 |
| Fragrance/solvent | as added below | as added below |
| Water | balance | balance |

TABLE IV

| Fragrance/ Solvent | Level | Based Used | Viscosity* | Spindle* |
|---|---|---|---|---|
| IFF** | 0.00 | A | 7620.00 | 3.00 |
| " | 0.02 | A | 8980.00 | " |
| " | 0.04 | A | 9980.00 | " |
| " | 0.06 | A | 11000.00 | " |
| Sozio*** | 0.00 | B | 4140.00 | " |
| " | 0.02 | B | 4720.00 | " |
| " | 0.04 | B | 5220.00 | " |
| " | 0.06 | B | 5940.00 | " |
| " | 0.08 | B | 6640.00 | " |
| " | 0.10 | B | 7200.00 | " |
| Tetrahydro-myrcenol | 0.00 | A | 8420.00 | " |
| | 0.02 | A | 11300.00 | " |
| | 0.04 | A | 15500.00 | " |
| | 0.06 | A | 21200.00 | 4.00 |
| | 0.08 | A | 25500.00 | " |

TABLE IV-continued

| Fragrance/ Solvent | Level | Based Used | Viscosity* | Spindle* |
|---|---|---|---|---|
| | 0.10 | A | 28600.00 | " |
| | 0.15 | A | 36400.00 | T-bar Spindle C |

*Viscosity measured on Brookfield RVT Viscometer, 21° C., @5 rpm, using indicated spindle.
**Proprietary fragrance containing a terpineol.
***Proprietary fragrance containing a terpineol.

There have accordingly been described above a number of embodiments and illustrative examples of formulations of liquid cleaning and/or hypochlorite bleach compositions according to the present invention. Additional variations and modifications of those embodiments and examples in accordance with the invention will be apparent in addition to those specifically set forth above. Accordingly, it is to be understood that the above disclosure of the invention is not limiting but is set forth in order to facilitate an understanding of the invention. The scope of the invention including modifications and additions as noted above is further defined by the following appended claims which are further exemplary of the invention.

What is claimed is:

1. A gelled hypochlorite-based cleaner having enhanced chemical stability of the composition and phase stability, said cleaner consisting essentially of:

(a) about 0.2 to about 5% of a cross-linked polyacrylate polymer;

(b) about 0.2 to about 5% of a bleach-stable surfactant;

(c) about 0.1 to about 10% a source of a high purity, high strength hypochlorite; and (d) the balance, water.

2. The gelled cleaner of claim 1 further comprising a $C_{6-24}$ alkyl carboxylate.

3. The gelled cleaner of claim 1 in which the source of hypochlorite of (c) is potassium or sodium hypochlorite.

4. The gelled cleaner of claim 3 in which the source of hypochlorite is sodium hypochlorite.

5. The gelled cleaner of claim 3 in which the source of hypochlorite is potassium hypochlorite.

6. The gelled cleaner of claim 1 in which the viscosity is up to 50,000 cps.

7. The gelled cleaner of claim 3 wherein the chloride salt content of the hypochlorite is less than 5%.

8. The gelled cleaner of claim 1 further comprising a solvent co-thickener.

9. The gelled cleaner of claim 8 wherein said solvent thickener is a terpene derivative.

10. The gelled cleaner of claim 9 wherein said terpene derivative is selected from the group consisting of terpene alcohols, esters, ethers, aldehydes and mixtures thereof.

11. The gelled cleaner of claim 10 wherein said terpene derivative is tetrahydromyrcenol.

12. The gelled cleaner of claim 1 wherein the gel achieves yield values of about 75–5,000 dynes/cm$^2$.

13. The gelled cleaner of claim 1 wherein the resulting viscosity thereof is about 1,000 to about 100,000 cPs at 70° F.

* * * * *